US008162310B2

(12) United States Patent
Sunohara

(10) Patent No.: US 8,162,310 B2
(45) Date of Patent: Apr. 24, 2012

(54) MEDIUM FEEDING DEVICE AND IMAGE FORMING DEVICE

(75) Inventor: Takahiro Sunohara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 80 days.

(21) Appl. No.: 12/659,310

(22) Filed: Mar. 4, 2010

(65) Prior Publication Data

US 2010/0244373 A1 Sep. 30, 2010

(30) Foreign Application Priority Data

Mar. 26, 2009 (JP) ..... 2009-075612

(51) Int. Cl.
*B65H 3/06* (2006.01)

(52) U.S. Cl. ..... 271/109; 271/9.09; 271/171

(58) Field of Classification Search ..... 271/117, 271/9.09, 171, 109, 10.04, 10.13; 399/392
See application file for complete search history.

(56) References Cited

U.S. PATENT DOCUMENTS

| | | | | |
|---|---|---|---|---|
| 7,036,813 | B2 * | 5/2006 | Asada | 271/117 |
| 7,383,015 | B2 * | 6/2008 | Sato | 399/392 |
| 7,677,556 | B2 * | 3/2010 | Murayama et al. | 271/162 |
| 2006/0197276 | A1 * | 9/2006 | Tanaka | 271/118 |

FOREIGN PATENT DOCUMENTS

| | | | |
|---|---|---|---|
| JP | 05-134495 | A | 5/1993 |
| JP | 06-008551 | A | 1/1994 |
| JP | 06-083648 | U | 11/1994 |
| JP | 11-227950 | A | 8/1999 |
| JP | 2007-070044 | A | 3/2007 |
| JP | A-2007-084289 | | 4/2007 |
| JP | 2008-087877 | A | 4/2008 |

* cited by examiner

*Primary Examiner* — Jeremy R Severson
(74) *Attorney, Agent, or Firm* — Posz Law Group, PLC

(57) ABSTRACT

A medium feeding device includes: a sheet holding unit, which holds a sheet and is pivotally attached to a device main unit so that the sheet holding unit is pivotal between open and closed positions; a sheet feeding roller that is located close to the sheet holding unit and that feeds the sheet to the inside of the device main unit; and a driving shaft that is located on an axis that is different from a rotation shaft for the sheet feeding roller and that drives the rotation shaft.

20 Claims, 7 Drawing Sheets

MEDIUM FEEDING DEVICE AND IMAGE FORMING DEVICE

CROSS REFERENCE

The present application is related to, claims priority from and incorporates by reference Japanese patent application number 2009-075612, filed on Mar. 26, 2009.

TECHNICAL FIELD

The present invention relates to a medium feeding device that feeds a sheet, or a printing medium, to a device main unit and also relates to an image forming device that includes the medium feeding device, such as a printer, a photocopier, a facsimile device, or the like.

As disclosed in, for example, Japanese laid-open patent application publication number 2007-84289, a conventional image forming device, for example, a printer, a photocopier, a facsimile device, or the like, has a medium feeding device that is rotatably attached to a side of a device main unit for feeding a sheet to an image forming unit in which an image is formed.

The medium feeding device has a sheet stacking tray in which a side guide for regulating a sheet width protrudes. This tray is rotatably attached to the side of the device main unit. A sheet feeding roller is attached inside the side of the device main unit to feed a sheet to the inside of the device main unit while the roller contacts the sheet stacked on the tray. The sheet feeding roller is configured to be held by a frame of the side of the device main unit through a shaft (an axis) and to be driven.

When used, the tray is opened to rotate it to outside from the side of the device main unit, and sheets are stacked along with the side guide that protrudes on the tray. Then, an upper part of the sheet is pressed toward the sheet feeding roller by a spring or the like. The sheet is fed to the inside of the device main unit by the sheet feeding roller and is printed at the image forming unit. After use, the tray is closed by rotating it to inside so as to contain the side guide that protrudes on the tray in the inside of the device main unit without change.

Accordingly, it was difficult to reduce the size of such a conventional image forming device. The disclosed embodiments hereinafter aim to reduce the size of the image forming device.

SUMMARY

A medium feeding device of the present application includes: a sheet holding unit, which holds a sheet and is pivotally attached to a device main unit so that the sheet holding unit is pivotal between open and closed positions; a sheet feeding roller that is located close to the sheet holding unit and that feeds the sheet to the inside of the device main unit; and a driving shaft that is located on an axis that is different from a rotation shaft for the sheet feeding roller and that drives the rotation shaft.

In another aspect, an image forming device of the present application has a medium feeding device and an image forming unit. The medium feeding device further includes: a sheet holding unit, which holds a medium and is pivotally attached to a device main unit so that the sheet holding unit is pivotal between open and closed positions; a sheet feeding roller that is located close to the sheet holding unit and that feeds the medium to the inside of the device main unit; and a driving shaft that is located on an axis that is different from a rotation shaft for the sheet feeding roller and that drives the rotation shaft, and the image forming unit forms an image on the medium fed by the medium feeding device.

With such a configuration, an image forming device can be downsized.

DETAILED DESCRIPTION

Figure 1:
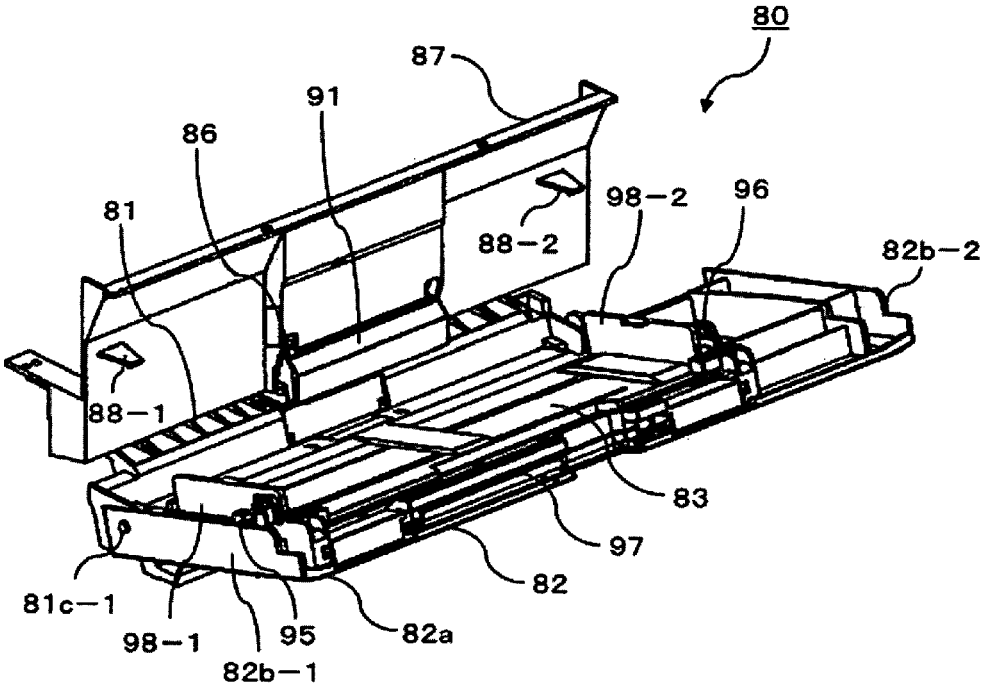
FIG. 1 is a perspective view of a medium feeding device 80 shown in FIG. 2 according to a first embodiment of the present invention.

An embodiment of the present invention will be clear with reference to a preferred embodiment discussed below and illustrated in the drawings. Note that drawings are substantially for the purpose of description and are not for limiting the scope of the present invention.

Figure 2:
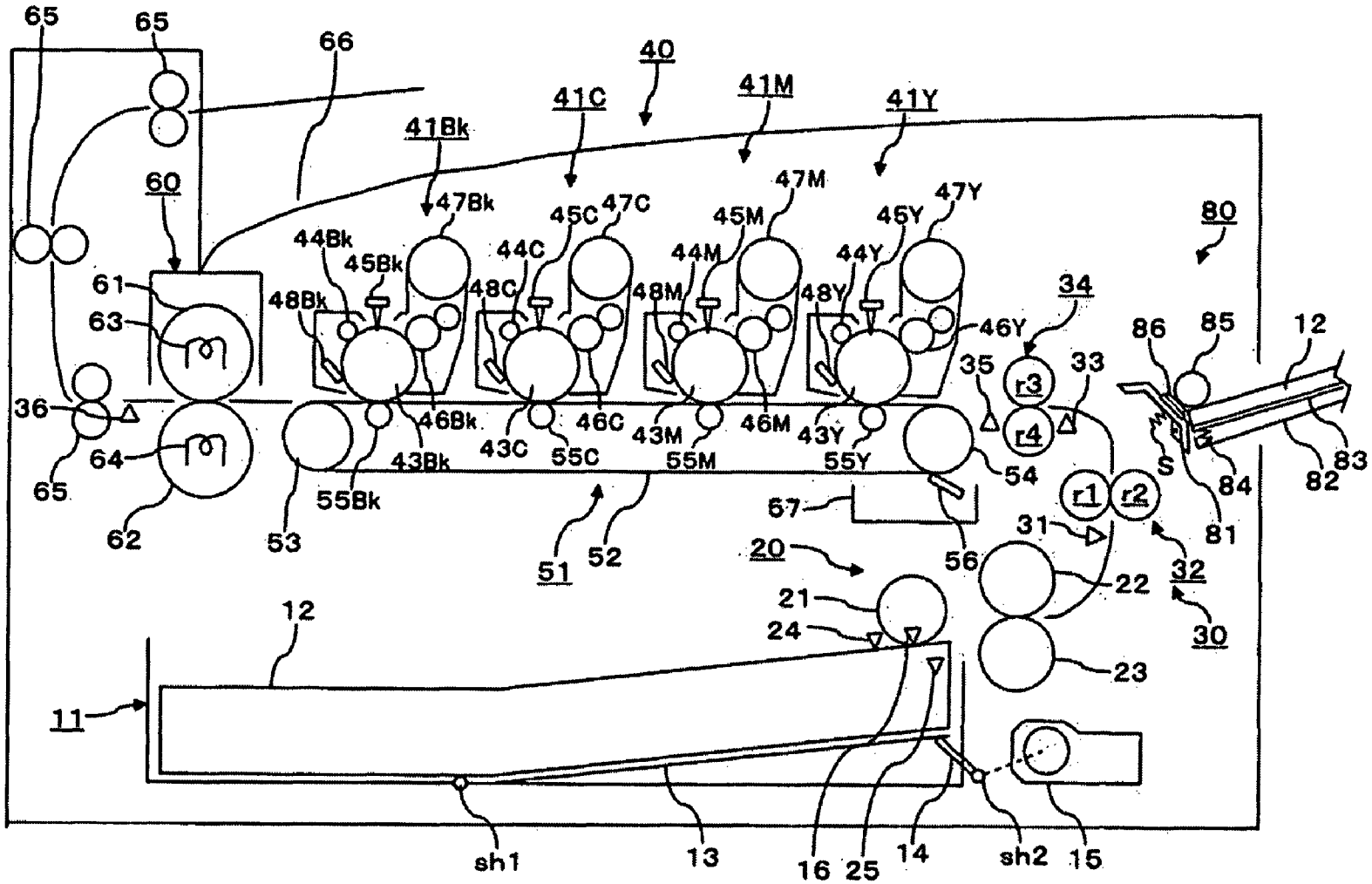
FIG. 2 is a schematic view of an image forming device according to a first embodiment of the present invention.

First Embodiment (Overall Structure of Image Forming Device According to First Embodiment) FIG. 2 is a schematic view of an image forming device according to a first embodiment of the present invention.

The image forming device is, for example, a color printer that uses electrographic system. A sheet feeding tray 11 is detachably attached to a lower part of the inside of a device main unit. A sheet stacking board 13 in which a sheet 12 as a printing medium is stacked is rotatably attached by a fulcrum sh1, which is formed by a shaft in the sheet feeding tray 11. A guide (not shown) regulates the stacking position of the sheet 12 is provided in the sheet feeding tray 11. The guide 12 leads and regulates the side edge of the sheet 12 in an orthogonal direction to a sheet feeding direction of the sheet 12 so that the position of the sheet 12 is configured.

A lift up lever 14 is rotatably attached by a fulcrum sh2 in the front edge part of the sheet feeding side of the sheet feeding tray 11. The fulcrum sh2 can be linked to a drive motor 15 that is for stacking a medium. When the sheet feeding tray 11 is attached to the device main unit, the lift up lever 14 and the drive motor 15 are linked. Then, the drive motor 15 is driven based on medium lifting up control by a control unit (not shown) so that the lift up lever 14 rotates. As a result, a bottom plane of the sheet stacking board 13 is lifted up by the tip of the lift up lever 14, and the leading edge of the sheet 12 is raised.

An ascent detection unit 16, which detects an ascent position of the sheet leading edge, and a sheet feeding unit 20 are provided above the leading edge of the sheet 12. When the leading edge of the sheet 12 is raised to a certain height, the ascent detection unit 16 detects the leading edge and sends the detection result to the control unit (not shown). The control unit instructs the drive motor 15 to stop the rotation of the lift up lever 14 based on the detection result of the ascent detection unit 16.

The sheet feeding unit 20 presses and contacts the stacked sheets 12 and feeds the sheets 12 one by one. The sheet feeding unit 20 is configured with a pickup roller 21 for feeding the sheet, a feed roller 22, which has a feed mechanism to separate the fed sheet 12 from the stack, and a retard roller 23, which has a retard mechanism to separate the fed sheet 12 from other sheets. In the vicinity of the pickup roller 21, a medium existence or nonexistence detection unit 24, which detects existence or nonexistence of the sheet 12, and a medium remaining detection unit 25, which detects the sheets 12 that remain, are provided. The sheet 12 that is fed by the sheet feeding unit 20 and that is separated by the feed roller 22 and the retard roller 23 is sent to a medium carrying unit 30.

The medium carrying unit 30 has a medium sensor 31, a pair of carrying rollers 32, which includes a pair of rollers r1 and r2, a medium sensor 33, a pair of carrying rollers 34, which includes a pair of rollers r3 and r4, and a writing sensor 35. The medium sensor 31 detects the leading edge of the passing sheet 12. The pair of carrying rollers 32 is located downstream of the medium sensor 31. The pair of carrying rollers 32 rotates by the control of the control unit (not shown), which receives the detection result of the medium sensor 31, and sends the sheet 12 downstream. Because the start timing for the rotation of the pair of carrying rollers 32 is delayed by the control of the control unit (not shown), the sheet 12 is pinched by a pressing and contacting part formed between the rollers r1 and r2 of the pair of carrying rollers 32 so that any skewing of the sheet 12 is corrected.

The pair of carrying rollers 34 is downstream of the pair of carrying rollers 32 and the medium sensor 33. The medium sensor 33 detects the leading edge of the passing sheet 12. The pair of carrying rollers 34 rotates by the control of the control unit (not shown), which receives the detection result of the medium sensor 33, and carries the sheet 12 to an image forming unit 40 and past the writing sensor 35, which detects a leading edge of a sheet.

The image forming unit 40 has four image forming units 41Y, 41M, 41C, and 41B*k* that are arranged in series and a transferring unit 51 in which a toner image as a developer image formed by the image forming units 41Y, 41M, 41C, and 41B*k* is transferred to the sheet 12 by coulomb force.

The image forming unit 41Y is configured with a photoreceptor drum (OPC) 43Y, which serves as an image carrier that carries a toner image, a charge roller 44Y, which serves as a charge device that charges the surface of the photoreceptor drum 43Y, a light emitting diode (LED), which exposes the surface of the charged photoreceptor drum 43Y and forms an electrostatic latent image, a printing head 45Y in array, a developing roller 46Y, which serves as a developing unit and forms a yellow toner image on the formed electrostatic latent image by frictional charge, a toner supplying unit 47Y, which supplies yellow toner as a developer, and a cleaning device 48Y, which removes residual toner on the photoreceptor drum 43Y.

Similarly, the image forming unit 41M is configured with a photoreceptor drum 43M, a charge roller 44M, a printing head 45M, a developing roller 46M, which forms a magenta toner image on the formed electrostatic latent image by frictional charge, a toner supplying unit 47M, which supplies magenta toner as a developer, and a cleaning device 48M. The image forming unit 41C is configured with a photoreceptor drum 43C, a charge roller 44C, a printing head 45C, a developing roller 46C, which forms a cyan toner image on the formed electrostatic latent image by frictional charge, a toner supplying unit 47C, which supplies cyan toner as a developer, and a cleaning device 48C. Further, the image forming unit 41B*k* is configured with a photoreceptor drum43B*k*, a charge roller 44B*k*, a printing head 45B*k*, a developing roller 46B*k*, which forms a black toner image on the formed electrostatic latent image by frictional charge, a toner supplying unit 47B*k*, which supplies black toner as a developer, and a cleaning device 48B*k*.

The transferring unit 51 has a transferring belt 52, which serves as a carrying unit, which carries the sheet 12 by electrostatic stiction, a drive roller 53, which rotates to drive the transferring belt 52 with a carrying motor (not shown), a tension roller 54, which is located apart from the drive roller 53, and transferring rollers 55Y, 55N, 55C, and 55B*k*, which serve as transferring devices that transfer a toner image to the sheet 12 by pressing and contacting the photoreceptor drums 43Y, 43M, 43C, and 43B*k*. Further, a cleaning blade 56, which scrapes adhered toner on the transferring belt 52 for cleaning, a toner box 57, which serves as a developer container unit that contains and stacks the scraped toner, and so on are provided.

The image forming units 41Y, 41M, 41C, and 41B*k* and the transferring belt 52 are synchronously operated to sequentially transfer and overlap toner images of each color to the sheet 12 on the transferring belt 52. After a color toner image is formed, the sheet 12 on which the color toner image is formed is sent to a fuser 60 located downstream.

The fuser 60 is configured with a pair of rollers that includes an upper roller 61, the surface of which is made of an elastic body, and a lower roller 62. A heat source 63 (for example, a halogen lamp) is located inside the upper roller 61. A heat source 64 (for example, a halogen lamp) is located inside the lower roller 62. The fuser 60 functions to fuse the color toner image to the sheet 12 by applying heat and pressure to melt the color toner image on the sheet 12 that is sent from the image forming unit 40.

The sheet 12 that is sent from the fuser 60 passes an ejecting sensor 36, which detects a sheet, or medium. After the ejecting sensor detects the leading edge of the sheet 12, the sheet 12 is ejected to a stacker unit 66 by a pair of ejecting rollers 65, which are located at predetermined several places on a carrying path.

A medium feeding device 80, which can be opened and closed, is attached to an opening formed in the side of the device main unit of the printer. The medium feeding device 80 is for feeding a thin sheet, a thick sheet, a narrow width sheet, and other odd sheets that the sheet feeding tray cannot feed. A sheet guide 81 is attached to the inside part of the device main unit for leading and feeding the sheet 12 to the inside of the device main unit. A sheet holding unit (for example, an outer cover) 82, which opens and closes the opening in the side of the device main unit, is pivotally attached to the sheet guide 81. The outer cover 82 is configured with a part of a tray like shape that is open when used and that is closed when not being used. A sheet stacking board 83 is attached on the inner surface of the outer cover 82. An outer side of the sheet stacking board 83 is axially attached to the outer cover 82. An inner side of the sheet stacking board 83 can move up and down. The sheet stacking board 83 is biased in an upward direction by a spring 84 that is provided at the bottom surface as shown. The sheet stacking board 83 functions as a multipurpose tray (MPT) or a manual sheet feeding tray.

A sheet feeding roller 85 is provided above the inner side of the sheet stacking board 83. The sheet feeding roller 85 is pressed and contacted by a separation unit 86, which is attached to the sheet guide 81 at a lower surface of the sheet feeding roller 85 and is biased by a spring S. The sheet feeding roller 85 presses and contacts the sheet 12 that is stacked on the inner surface of the sheet stacking board 83 to feed the sheet 12 to the inside of the device main unit. The separation unit 86 is configured with a separation frame 86*a*, which is axially supported by the sheet guide 81, and a separation pad 86*b*, which is made of a rubber sheet or the like bonded on the separation frame 86*a*. The separation unit 86 separates the fed sheet 12 from other sheets and sends it to the pair of carrying rollers 34.

Figure 3:
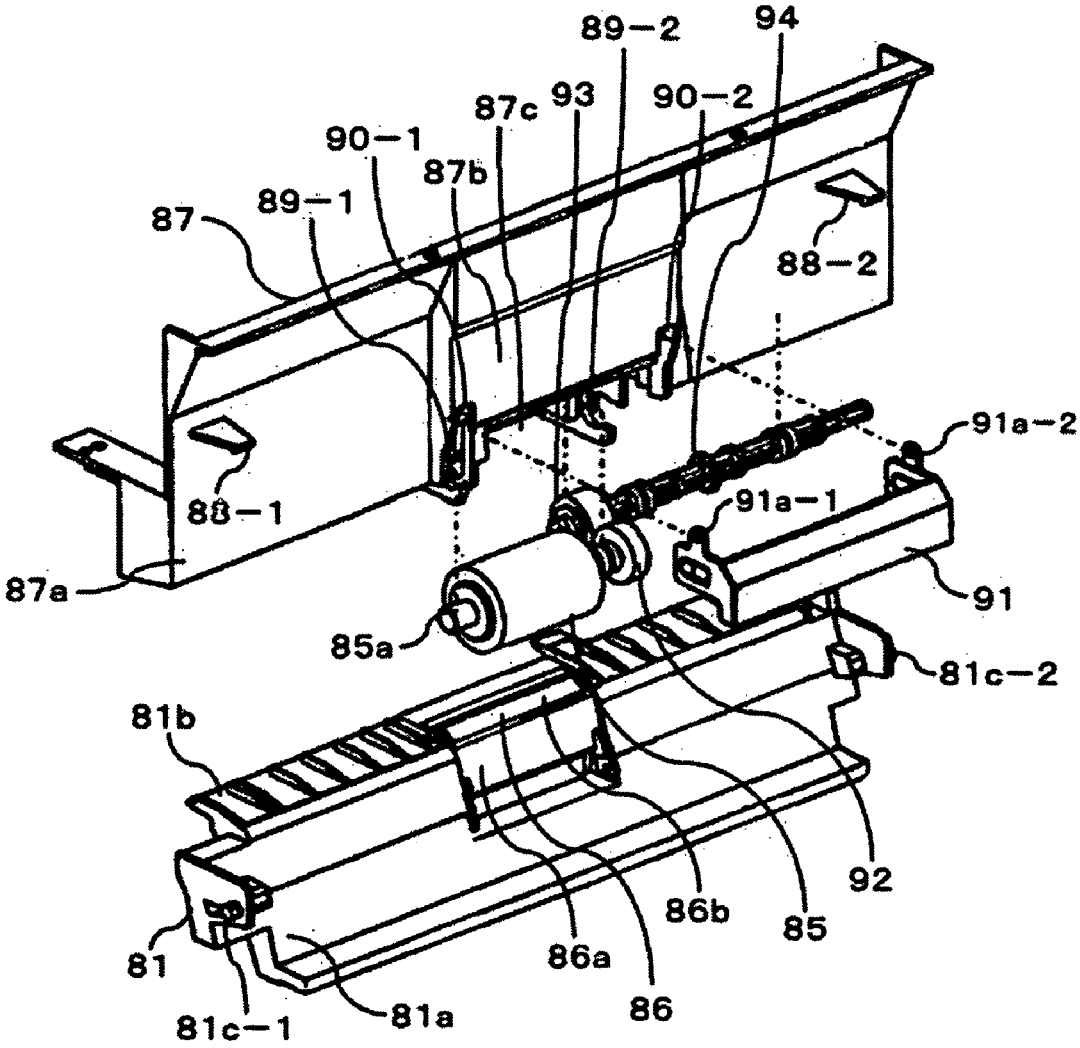
FIG. 3 is an exploded perspective view of a part of a medium feeding device 80 shown in FIG. 1.
Figure 4:
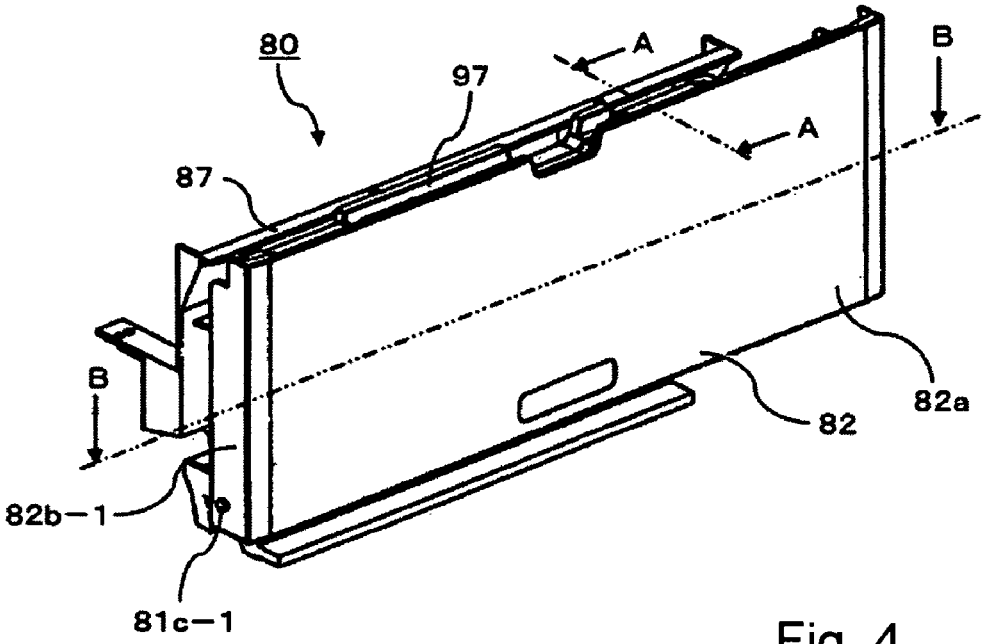
FIG. 4 is a perspective view of a medium feeding device 80 shown in FIG. 1 at the time of closing.
Figure 5:
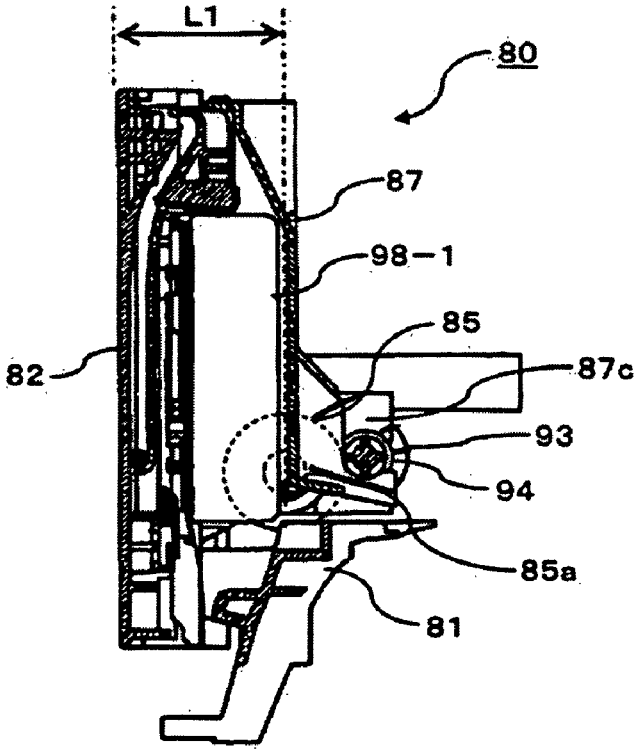
FIG. 5 is a sectional view taken along line A-A shown in FIG. 4.
Figure 6:
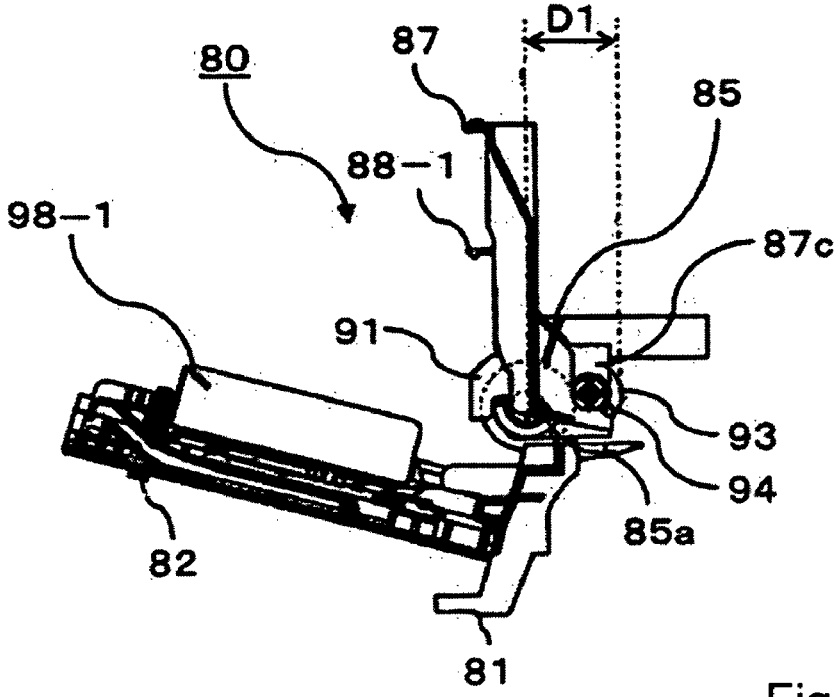
FIG. 6 is a sectional view of a medium feeding device 80 shown in FIG. 5 at the time of opening.
Figure 7:
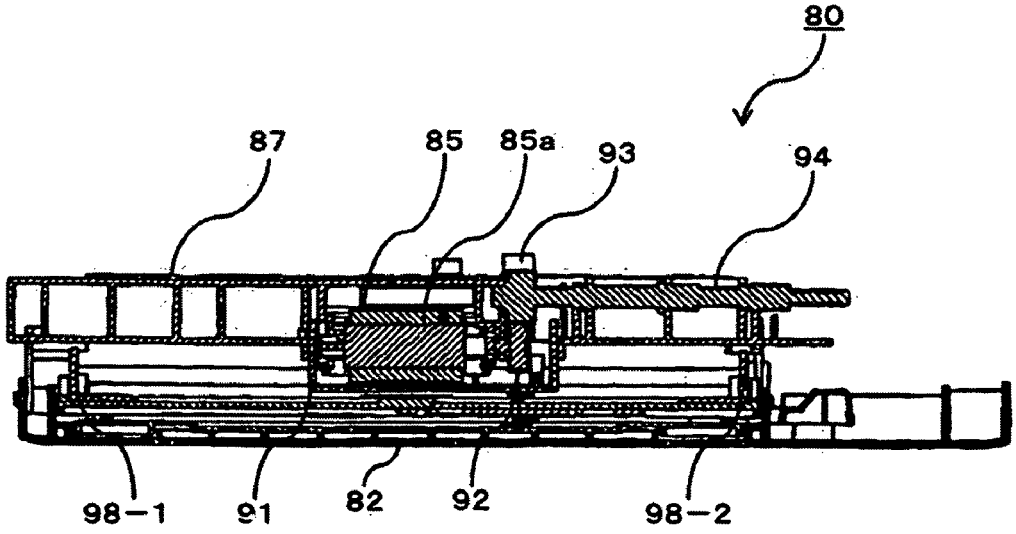
FIG. 7 is a sectional view taken along line B-B shown in FIG. 4.
Figure 8:
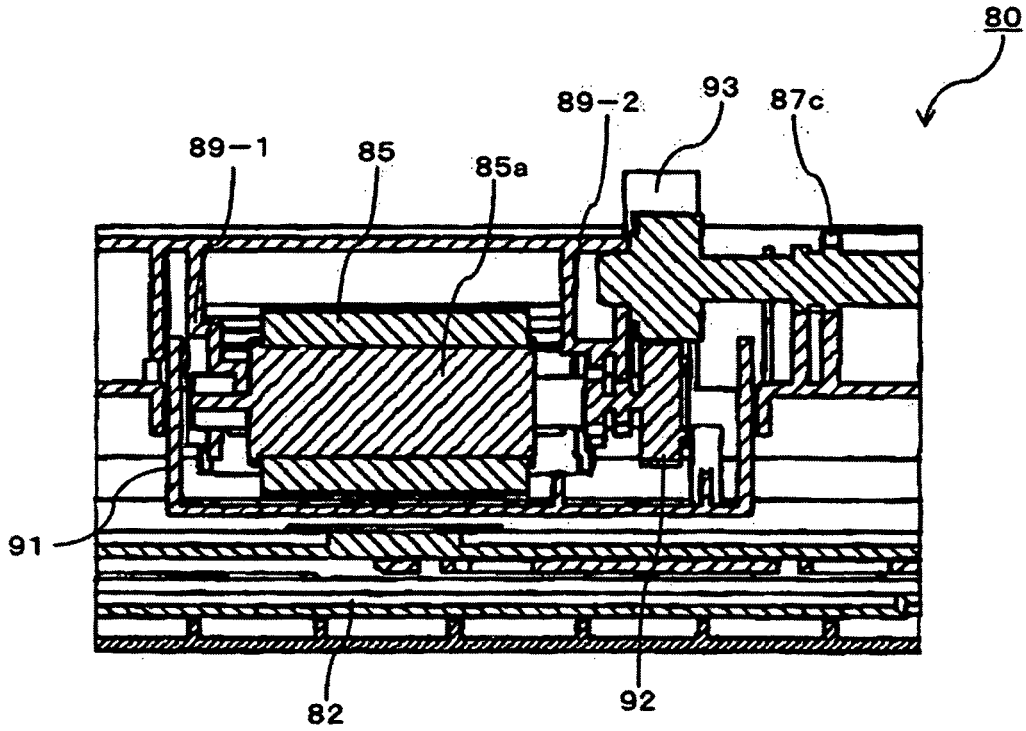
FIG. 8 is an enlarged view of a part of FIG. 7.

(Detailed Structure of Medium Feeding Device According to First Embodiment) FIG. 1 is a perspective view of a medium feeding device 80 shown in FIG. 2 according to a first embodiment of the present invention. FIG. 3 is an exploded perspective view of a part of a medium feeding device 80 shown in FIG. 1. FIG. 4 is a perspective view of a medium feeding device 80 shown in FIG. 1 at the time of closing. FIG. 5 is a sectional view taken along with the A-A line shown in FIG. 4. FIG. 6 is a sectional view of a medium feeding device 80 shown in FIG. 5 at the time of opening. FIG. 7 is a sectional view taken along with the B-B line shown in FIG. 4. And FIG. 8 is an enlarged view of a part of FIG. 7.

A roller holding frame 87 is fixed inside the opening of the main unit of the image forming device, is located above the sheet guide 81, and is away from the sheet guide 81 by a certain distance in the medium feeding device 80. The roller holding frame 87 has a frame main unit 87*a* with a substantially plate-like shape that is fixed to the main unit of the image forming device. A pair of engagement projections 88-1 and 88-2 that project from the frame main unit 97*a* are provided in the vicinity of the sides of the frame main unit 87*a*, respectively. A protrusion member (for example, protrusion part) 87*b* that protrudes toward the opening in a longitudinal direction is formed substantially half-way between the engagement projections 88-1 and 88-2. The protrusion part 87*b* has a certain width in the longitudinal direction. An opening portion 87*c* is formed at a lower part of the protrusion part 87*b*. A pair of sheet feeding roller bearing units 89-1 and 89-2 are formed at opposite ends of the opening portion 87*c* in a lateral direction. A pair of roller cover fulcrum receiving parts 90-1 and 90-2 are formed above the sheet feeding roller bearing units 89-1 and 89-2 and are spaced apart in a lateral direction.

The sheet feeding roller 85 is located between the pair of sheet feeding roller bearing units 89-1 and 89-2. Opposite ends of a rotation shaft (for example, sheet feeding roller shaft) 85*a*, which is provided at a center of the sheet feeding roller 85, are detachably supported by the sheet feeding roller bearing units 89-1 and 89-2. A roller cover 91 covers an upper part of the sheet feeding roller 85. The roller cover 91 has a pair of fulcrums 91*a*-1 and 91*a*-2 that protrude from side planes, respectively, at opposite ends of the roller cover 91. The fulcrums 91*a*-1 and 91*a*-2 are axially supported by the pair of roller cover fulcrum receiving parts 90-1 and 90-2 so that the roller cover 91, which can be opened and closed to cover an upper part of the sheet feeding roller 85.

A gear 92 is attached to one end of the sheet feeding roller shaft 85*a*. Another gear 93 mates with the gear 92 at a back side of the gear 92 (namely, inside of the main unit of the image forming device). One end of a sheet feeding roller driving shaft 94 is attached to the gear 93. The sheet feeding roller driving shaft 94 is axially supported by the opening portion 87*c*, which is formed at a lower part of the back side (namely, an inner side of the main unit of the image forming device) of the frame main unit 87*a*. As shown in FIG. 6, the sheet feeding roller 85, the sheet feeding roller shaft 85*a* and the gear 92, and the gear 93 and the sheet feeding roller driving shaft 94 are parallel on the same horizontal plane. A horizontal distance from the center of the sheet feeding roller shaft 85*a* to the back side of the gear 93 is D1 (See FIG. 6).

The sheet guide 81 under the roller holding frame 87 has a guide main unit 81*a* with a substantially rectangle plate-like shape. The sheet guide 81 is fixed to the main unit of the image forming device and inclines to the inside of the main unit of the image forming device. A sheet carrying guide 81*b*, which has a substantially rectangle plate-like shape and guide projections to take and guide the sheet 12 in the inside of the device main unit, is provided at an upper part of the guide main unit 81*a*. The separation frame 86*a* is axially supported at substantially the center of the sheet carrying guide 81*b*. The separation pad 86*b*, which is bonded to the separation frame 86*a*, presses and contacts the sheet feeding roller 85. A pair of fulcrums 81*c*-1 and 81*c*-2 protrude from opposite side planes of the guide main unit 81*a*.

The outer cover 82 is rotatably attached to the fulcrums 81*c*-1 and 81*c*-2, which serve as rotating shafts. The outer cover 82 is configured with a tray-like shape and has a cover main unit 82*a* with a substantially rectangular plate-like shape and cover side walls 82*b*-1 and 82*b*-2, which are provided at opposite side planes of the cover main unit 82*a*. One end of the cover side walls 82*b*-1 and 82*b*-2 is rotatably attached to fulcrums 81*c*-1 and 81*c*-2, as shown in FIG. 4. A latching part 95 and a stopper 96, which are latched with the pair of engagement projections 88-1 and 88-2, respectively, of the roller holding frame 87 side when the outer cover 82 is closed, are provided in the vicinity of the pair of cover side walls 82*b*-1 and 82*b*-2 of the outer cover 82. As shown in FIG. 5, when the outer cover 82 is closed, a distance between the cover main unit 82*a* and the frame main unit 87*a* is set as a certain distance L1.

An auxiliary tray 97, which can be pulled, is attached on the inner surface of the cover main unit 82*a*. The sheet stacking board 83 is further attached on the auxiliary tray 97. One side plane of the sheet stacking board 83 in a pulling side of the auxiliary tray 97 is axially attached to the cover side walls 82*b*-1 and 82*b*-2. Another side plane of the sheet stacking board 83 in a sheet guide side can move up and down and is biased by the spring 84 that is provided under the bottom surface so as to be able to up. A pair of sheet width regulation guides 98-1 and 98-2 that regulates the sides (namely, width) of stacked sheets and that can move in the width direction is provided in the vicinity of both sides on the sheet stacking board 83. When the outer cover 82 is closed, the sheet width regulation guides 98-1 and 98-2 are contained in the frame main unit 87*a* side.

(Overall Operation of the Image Forming Device According to the First Embodiment)

A front edge of the sheet stacking board 13 in which the sheet 12 in the sheet feeding tray 11 is stacked is raised by the lift up lever 14 driven by the drive motor 15, so that the leading edge of the sheet 12 is pressed and contacted by the pickup roller 21. The sheet 12 is fed by the rotation of the pickup roller 21, which is rotated by a motor (not shown). The sheet 12 is separated by the feed roller 22 and the retard roller 23 from other sheets. The sheet 12 is fed to the pair of carrying rollers 32 through the medium sensor 31. When the leading edge of the passing sheet 12 is detected by the medium sensor 31, the pair of carrying rollers 32 rotates by the control of the control unit (not shown) that receives the detection result from the medium sensor 31. Then, the sheet 12 is fed to the pair of carrying rollers 34 through the medium sensor 33.

When the leading edge of the passing sheet 12 is detected by the medium sensor 33, the pair of carrying rollers 34 rotates by the control of the control unit (not shown) that receives the detection result from the medium sensor 33. Then, the sheet 12 is carried to the image forming unit 40 through the writing sensor 35, which is for detecting a leading edge of a sheet. When the leading edge of the sheet 12 is detected by the writing sensor 35 and when the detection result is sent to the control unit (not shown), the image forming unit 40 operates by the control of the control unit. On this occasion, the image forming units 41Y, 41M, 41C, and 41B*k* and the transferring belt 52 are synchronously operated to sequentially transfer and overlap toner images of each color to the sheet 12 on the transferring belt 52. As a result, a color toner image is formed.

The color toner image that is formed on the sheet 12 is melted and fused to the sheet 12 by applying heat and pressure in the fuser 60. The sheet 12 that is sent from the fuser 60 passes the ejecting sensor 36 that is for detecting a medium. After the ejecting sensor detects the leading edge of the sheet 12 and after the detection result is sent to the control unit (not shown), the sheet 12 is ejected to the stacker unit 66 by the pair of ejecting rollers 65.

(Operation of Medium Feeding Device According to First Embodiment) In FIGS. 1 and 3-8, when the medium feeding device 80 is used as an MPT or a manual sheet feeding tray and when the outer cover 82 is pivoted to a lower position, the latching part 95 and the stopper 96 in the cover main unit 82*a* side are released from the engagement projections 88-1 and 88-2 in the roller holding frame 87 side so that the outer cover 82 is open, since the fulcrums 81*c*-1 and 81*c*-2 in the sheet guide 81 side form pivot joints. The auxiliary tray 97 is pulled from the outer cover 82. Then, the sheet 12 is placed on the sheet stacking board 83 (or a plurality of sheets 12 are stacked on the sheet stacking board 83). The width direction of the sheet 12 is fixed by the sheet width regulation guides 98-1 and 98-2. The sheet stacking board 83 is raised by the spring 84 as shown in FIG. 2. Then, the leading edge of the sheet 12 is pressed and contacted at a lower part of the sheet feeding roller 85.

When the sheet feeding roller driving shaft 94 is rotated by a motor, which is controlled by the control unit (not shown), the sheet feeding roller 85 is driven by the gears 93 and 92, and the sheet 12 is fed. The fed sheet 12 is separated from other sheets by the separation pad 86*b* and is guided by the sheet carrying guide 81*b*. Then, the sheet 12 is sent to the pair of carrying rollers 34 through the medium sensor 33 that is shown in FIG. 2.

When the leading edge of the passing sheet 12 is detected by the medium sensor 33, the pair of carrying rollers 34 rotates by the control of the control unit (not shown), which receives the detection result from the medium sensor 33. Then, the sheet 12 is carried to the image forming unit 40 through the writing sensor 35. When the leading edge of the sheet 12 is detected by the writing sensor 35, as discussed above, and when the detection result is sent to the control unit (not shown), the image forming unit 40 operates. As a result, after the toner image is formed on the sheet 12 and is fused by the fuser 60, the sheet 12 is ejected to the stacker unit 66 by the pair of ejecting rollers 65.

When the medium feeding device 80 is not used, the sheet 12 is removed from the sheet stacking board 83. After the auxiliary tray 97 is stored inside of the outer cover 82, the outer cover 82 is pivoted in an upper direction. As a result, the outer cover 82 is closed while being pivoted about the fulcrums 81*c*-1 and 81*c*-2. The sheet width regulation guides 98-1 and 98-2, which are provided at the sheet stacking board 83, are stored in the frame main unit 87*a* side. At the same time, the latching part 95 and the stopper 96 in the cover main unit 82*a* side are linked with the engagement projections 88-1 and 88-2 in the roller holding frame 87 side. As a result, the outer cover 82 is fixed, and the opening of the main unit of the image forming device is closed.

In case of repair, for example, when replacing the sheet feeding roller 85 with new one, after the outer cover 82 is open, the roller cover 91 rotates in an upper direction. Because the roller cover 91 is open in the upper direction, since the fulcrums 91*a*-1 and 91*a*-2 in the roller cover 91 form a pivot axis, the sheet feeding roller shaft 85*a* of the sheet feeding roller 85, which is stored inside, is taken out from the sheet feeding roller bearing units 89-1 and 89-2 in the roller holding frame 87 side. After that, a new sheet feeding roller 85 is attached to the sheet feeding roller bearing units 89-1 and 89-2. Then, after the roller cover 91 is closed, the replacement work for the sheet feeding roller 85 is completed.

(Effect of First Embodiment)

The medium feeding device 80 and the image forming device that has the medium feeding device 80 according to the first embodiment have the following effects (a)-(d).

(a) The sheet feeding roller shaft 85*a* and the sheet feeding roller driving shaft 94 that drive the sheet feeding roller shaft 85*a* through the gears 92 and 93 are not provided on the same axis. The sheet feeding roller driving shaft 94 is offset in the horizontal direction to the inside of the main unit of the image forming device with respect to the sheet feeding roller shaft 85*a*. Therefore, because the sheet feeding roller bearing unit 87*c* and the frame main unit 87*a* provided in the roller holding frame 87 are located inside of the main unit of the image forming device, sheet width regulation guide storage space at the outer cover 82 side is relatively large. When the outer cover 82 is closed, the sheet width regulation guides 98-1 and 98-2 in standing condition are fitted inside of the main unit of the image forming device. Therefore, as shown in FIG. 5, the distance L1 between the center of the sheet feeding roller shaft 85*a* and the outer cover 82 can be relatively short, which permits a reduction in size of the image forming device.

(b) Because the sheet feeding roller bearing units 89-1 and 89-2, which are provided at the protrusion part 87*b* protruding from the frame main unit 87*a*, support both edges of the sheet feeding roller shaft 85*a*, the mechanical strength is relatively high. Further, inclination of the sheet 12 is prevented at the time of feeding the sheet 12 by the sheet feeding roller 85.

(c) Because the roller cover fulcrum receiving parts 90-1 and 90-2, which are provided at the protrusion part 87*b* protruding from the frame main unit 87*a*, rotatably support the roller cover 91, the sheet feeding roller 85 can be easily replaced while opening and closing the roller cover 91.

(d) Because the sheet 12 is separated from other sheets by the separation pad 86*b*, which is provided at the separation frame 86*a* located on the sheet carrying guide 81*b*, the device can be smaller compared with a separation structure that uses a roller.

(Comparison Example of First Embodiment)

Figure 9:
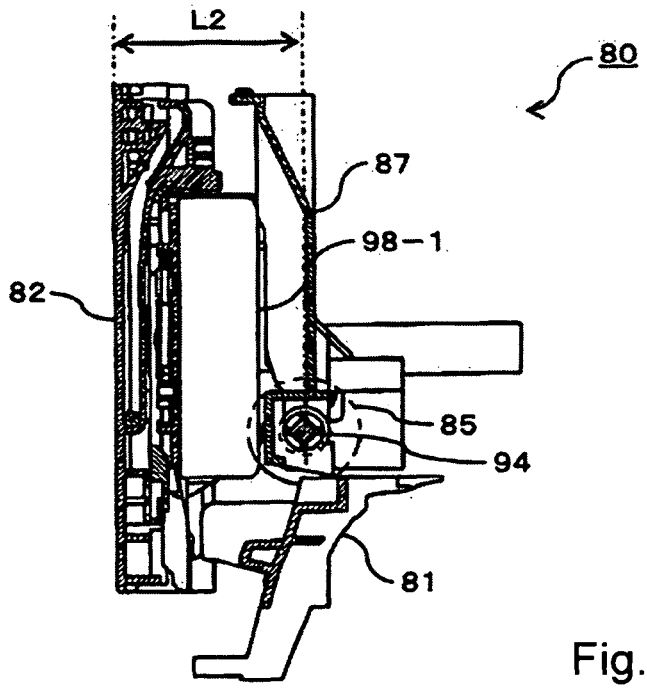
FIG. 9 is a sectional view of a medium feeding device 80 as a comparison example corresponding to FIG. 5 according to a first embodiment of the present invention.

FIG. 9 is a sectional view of a medium feeding device 80 as a comparison example corresponding to FIG. 5 according to a first embodiment of the present invention. When components of the comparison example in FIG. 9 are same as ones in FIG. 5 according to the first embodiment, those components have same reference numerals.

In the comparison example in FIG. 9, a sheet feeding roller 85 and a sheet feeding roller driving shaft 94 that drives the sheet feeding roller 85 are provided on the same axis. Both edges of the sheet feeding roller driving shaft 94 are supported by opposite side planes of a roller holding frame 87.

When an outer cover 82 is closed, the roller holding frame 87 is set back toward the inside of the main unit of the image forming device to make sheet feeding roller driving shaft storage space. This is because sheet width regulation guides 98-1 and 98-2 in the outer cover 82 side do not contact the sheet feeding roller driving shaft 94. Therefore, the distance L2 between the center of the sheet feeding roller driving shaft 94 and the outer cover 82 is longer than the distance L1 according to the first embodiment in FIG. 5. Therefore, in the comparison example of FIG. 9, it is difficult to reduce the size of the image forming device. In contrast, because the sheet feeding roller shaft 85*a* and the sheet feeding roller driving shaft 94 are not on the same axis but are provided on different axes in the first embodiment, the distance L1 is smaller than the distance L2 in the comparison example, which allows a reduction is size of the image forming device.

In the comparison example, because both edges of the sheet feeding roller driving shaft 94 are supported by the side planes of the roller holding frame 87, the length of thr sheet feeding roller driving shaft 94 that is for supporting the sheet feeding roller 85 is longer. Therefore, the mechanical strength is relatively small. As a result, the likelihood of problems, such as a paper jam or the like, by inclination of the sheet 12 at the time of feeding by the sheet feeding roller 85. Further, it is more difficult to replace the sheet feeding roller 85 in the comparison example. In contrast, the protrusion part 87*b* protruding from the frame main unit 87*a* supports both ends of the sheet feeding roller shaft 85*a* in the first embodiment. Further, in the first embodiment, the roller cover 91 that covers the sheet feeding roller 85*a* is rotatably supported. Therefore, the first embodiment resolves the disadvantages of the comparison example.

Second Embodiment

Figure 10:
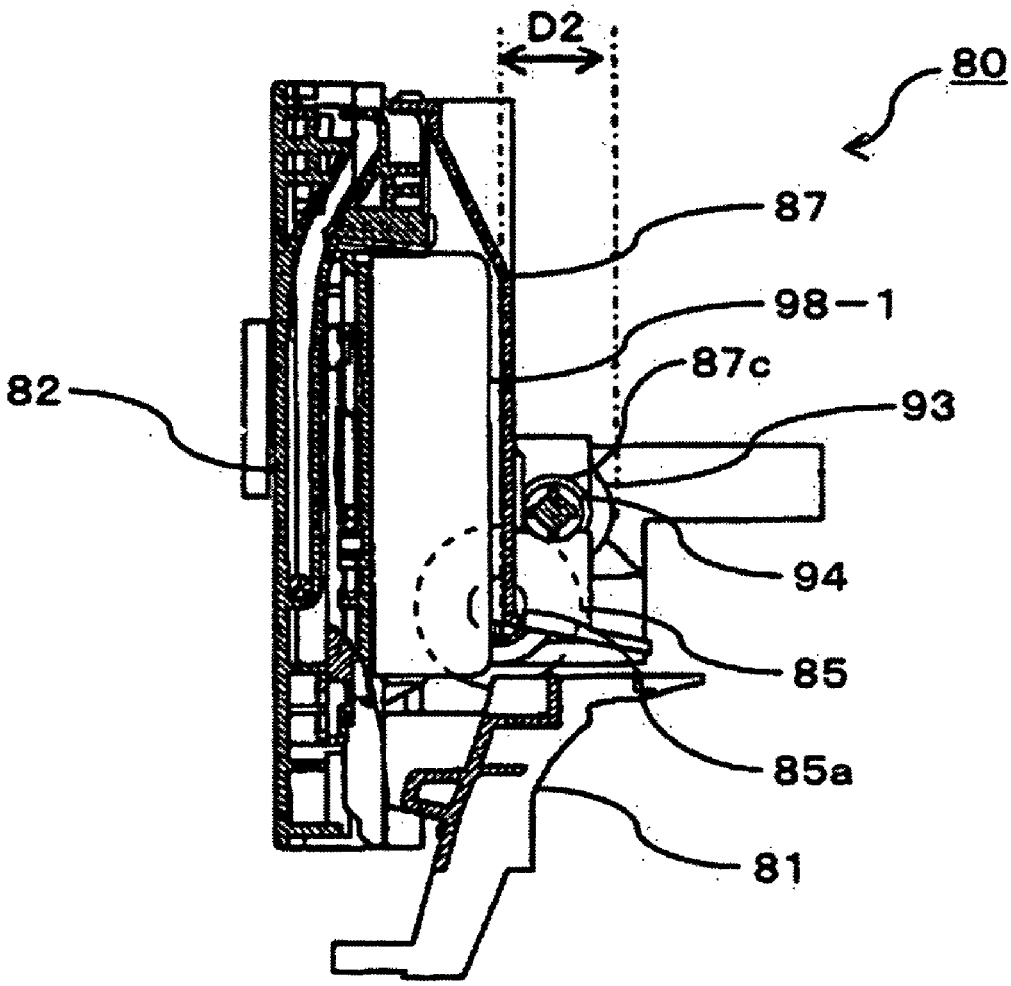
FIG. 10 is a sectional view of a medium feeding device 80 according to a second embodiment of the present invention.

FIG. 10 is a sectional view of a medium feeding device 80 according to a second embodiment of the present invention. When components of the second embodiment are same as those in FIGS. 5 and 6 of the first embodiment, those components have same reference numerals.

In FIGS. 5 and 6, according to the first embodiment, the sheet feeding roller driving shaft 94 is located at a place that is substantially horizontally offset with respect to the sheet feeding roller shaft 85*a*. Therefore, the distance D1 between the center of the sheet feeding roller shaft 85*a* and the outside diameter of the gear 93 is large.

In contrast, in this embodiment, the sheet feeding roller driving shaft 94 is located obliquely upward with respect to the sheet feeding roller shaft 85*a*. As a result, the distance D2 between the center of the sheet feeding roller shaft 85*a* and the outside diameter of the gear 93 is small compared with the distance D1 according to the first embodiment. Space inside of the image forming device can be expanded (namely, L1<L2, and D1>D2). Therefore, the size of the image forming device can be further reduced.

(Other Embodiment)

The present invention is not limited to the first and second embodiments discussed above and can be applicable to various applications and variations. Examples of the applications and variations are the following (i)-(iii).

(i) The entire structure, shape, and so on of the image forming device shown in FIG. 2 may be changed to one that is not shown in drawings. In the medium feeding device 80 shown in FIGS. 1, 3-8, and 10, the sheet guide 81, the outer cover 82, the roller holding frame 87, the sheet feeding roller 85, the roller cover 91, and so on may be changed to another structure, shape, and so on that are not shown in drawings.

(ii) The separation unit 86 is explained by the separation pad 86*b* as an example. However, it may be changed to a separation roller.

(iii) In the first and second embodiments, a printer device as an example for an image forming device is explained. However, the present invention can be applicable to a photocopy machine, a facsimile machine, a multifunction machine or the like.

The medium feeding device and the image forming device being thus described, it will be apparent that the same may be varied in many ways. Such variations are not to be regarded as a departure from the spirit and scope of the invention, and all such modifications as would be apparent to one of ordinary skill in the art are intended to be included within the scope of the following claims.

What is claimed is:

1. A medium feeding device comprising:

a sheet holding unit, which holds a sheet and is pivotally attached to a device main unit so that the sheet holding unit is pivotal between open and closed positions;

a sheet feeding roller that is located close to the sheet holding unit and that feeds the sheet to the inside of the device main unit;

a driving shaft that is located on an axis that is different from a rotation shaft for the sheet feeding roller and that drives the rotation shaft;

a sheet stacking board that is formed at the sheet holding unit; and a regulation guide that is provided on the sheet stacking board and that includes a wall extending in a direction that is perpendicular to the sheet stacking board, the wall of the regulation guide functioning to regulate the sheet width, wherein when seen from an axial view of the rotation shaft, the wall is positioned so as to overlap a portion of the sheet feeding roller.

2. The medium feeding device according to claim 1, wherein the sheet holding unit is pivotally attached to the device main unit about a pivot axis.

3. The medium feeding device according to claim 2, wherein the pivot axis is substantially parallel to the rotation shaft.

4. The medium feeding device according to claim 1, wherein a first gear is provided on the rotation shaft of the sheet feeding roller, a second gear is provided on the driving shaft, and the first gear and the second gear are mated.

5. The medium feeding device according to claim 1, wherein the location of the rotation shaft is outward of the driving shaft.

6. The medium feeding device according to claim 1, wherein the sheet holding unit further comprises:

an outer cover, which is pivotal between open and closed positions and is attached to the device main unit, and a sheet stacking board, which supports the sheet and is located at an inner side of the outer cover.

7. The medium feeding device according to claim 1, further comprising a protrusion member that protrudes from the device main unit and that detachably supports opposite ends of the rotation shaft.

8. The medium feeding device according to claim 1, further comprising a separation part that separates the sheet fed and contacted by the sheet feeding roller.

9. The medium feeding device according to claim 8, wherein the separation part has a separation pad.

10. The medium feeding device according to claim 1, wherein when seen from the axial view of the rotation shaft, the wall of the regulation guide is positioned so as to overlap a portion of the rotation shaft.

11. A medium feeding device comprising:

a sheet holding unit, which holds a sheet and is pivotally attached to a device main unit so that the sheet holding unit is pivotal between open and closed positions;

a sheet feeding roller that is located close to the sheet holding unit and that feeds the sheet to the inside of the device main unit;

a driving shaft that is located on an axis that is different from a rotation shaft for the sheet feeding roller and that drives the rotation shaft;

a protrusion member that protrudes from the device main unit and that detachably supports opposite ends of the rotation shaft; and a roller cover, which is pivotally attached to the protrusion member, wherein the roller cover pivots between a closed position, at which it covers an upper part of the sheet feeding roller, and an open position, at which the roller cover is separated from the sheet feeding roller.

12. A medium feeding device comprising:

a sheet holding unit, which holds a sheet and is pivotally attached to a device main unit so that the sheet holding unit is pivotal between open and closed positions;

a sheet feeding roller that is located close to the sheet holding unit and that feeds the sheet to the inside of the device main unit;

a driving shaft that is located on an axis that is different from a rotation shaft for the sheet feeding roller and that drives the rotation shaft;

a frame unit that detachably supports opposite ends of the rotation shaft; and a roller cover, which is pivotally attached to the frame unit, wherein the roller cover pivots between a closed position, at which it covers an upper part of the sheet feeding roller, and an open position, at which the roller cover is separated from the sheet feeding roller, wherein the roller cover pivots to the open position to permit removal and replacement of the sheet feeding roller.

13. An image forming device comprising a medium feeding device and an image forming unit, wherein the medium feeding device further comprises:

a sheet holding unit, which holds a medium and is pivotally attached to a device main unit so that the sheet holding unit is pivotal between open and closed positions;

a sheet feeding roller that is located close to the sheet holding unit and that feeds the medium to the inside of the device main unit; and a driving shaft that is located on an axis that is different from a rotation shaft for the sheet feeding roller and that drives the rotation shaft;

a sheet stacking board that is formed at the sheet holding unit; and a regulation guide that is provided on the sheet stacking board and that includes a wall extending in a direction that is perpendicular to the sheet stacking board, the wall of the regulation guide functioning to regulate the sheet width, wherein when seen from an axial view of the rotation shaft, the wall is positioned so as to overlap a portion of the sheet feeding roller, and the image forming unit forms an image on the medium fed by the medium feeding device.

14. A medium feeding device comprising:

a sheet holding unit, which is pivotally attached to a side of an image forming device so that the sheet holding unit is pivotal between an open position, in which the holding unit is ready for use, and a closed position, in which the holding unit is stored when not being used;

a sheet feeding roller, which is located at an inner end of the sheet holding unit, wherein the sheet feeding roller feeds a sheet from the sheet holding tray to the inside of the image forming device through an opening in the side of the image forming device, wherein the sheet feeding roller is supported by a rotation shaft, which is coaxial with the sheet feeding roller;

a driving shaft, which drives the rotation shaft, wherein axes of the driving shaft and the rotation shaft are parallel, and wherein the axis of the rotation shaft is located outward of the axis of the driving shaft;

a sheet stacking board that is formed at the sheet holding unit; and a regulation guide that is provided on the sheet stacking board and that includes a wall extending in a direction that is perpendicular to the sheet stacking board, the wall of the regulation guide functioning to regulate the sheet width, wherein when seen from an axial view of the rotation shaft, the wall is positioned so as to overlap a portion of the sheet feeding roller.

15. The medium feeding device according to claim 14, wherein the sheet holding unit pivots about a pivot axis that is parallel to the rotation shaft.

16. The medium feeding device according to claim 14, wherein:

the regulation guide comprises a pair of regulation guides, when the sheet holding unit is closed, the sheet feeding roller is located between the walls of the regulation guides; and the minimum distance between the regulation guides is greater than a total length of the rotation shaft, so that the walls of the regulation guides do not interfere with the rotation shaft when the sheet holding unit is closed.

17. The medium feeding device according to claim 14, further comprising:

a frame unit that detachably supports opposite ends of the rotation shaft;

a roller cover, which is pivotally attached to the frame unit, wherein the roller cover pivots between a closed position, at which it covers an upper part of the sheet feeding roller, and an open position, at which the roller cover is separated from the sheet feeding roller, wherein the roller cover pivots to the open position to permit removal and replacement of the sheet feeding roller.

18. The medium feeding device according to claim 14, wherein when seen from the axial view of the rotation shaft, the wall of the regulation guide is positioned so as to overlap a portion of the rotation shaft.

19. A medium feeding device comprising:

a sheet holding unit, which is pivotally attached to a side of an image forming device so that the sheet holding unit is pivotal between an open position, in which the holding unit is ready for use, and a closed position, in which the holding unit is stored when not being used;

a sheet feeding roller, which is located at an inner end of the sheet holding unit, wherein the sheet feeding roller feeds a sheet from the sheet holding tray to the inside of the image forming device through an opening in the side of the image forming device, wherein the sheet feeding roller is supported by a rotation shaft, which is coaxial with the sheet feeding roller; and a driving shaft, which drives the rotation shaft, wherein axes of the driving shaft and the rotation shaft are parallel, and wherein the axis of the rotation shaft is located outward of the axis of the driving shaft, wherein a roller cover is pivotally supported above the sheet feeding roller, and the roller cover is pivotal between a lower position, in which the roller cover covers an upper part of the sheet feeding roller, and an upper position, in which the sheet feeding roller is substantially exposed, and the roller cover pivots about a pivot axis that is parallel to the rotation shaft.

20. A medium feeding device comprising:

a sheet holding unit, which is pivotally attached to a side of an image forming device so that the sheet holding unit is pivotal between an open position, in which the holding unit is ready for use, and a closed position, in which the holding unit is stored when not being used;

a sheet feeding roller, which is located at an inner end of the sheet holding unit, wherein the sheet feeding roller feeds a sheet from the sheet holding tray to the inside of the image forming device through an opening in the side of the image forming device, wherein the sheet feeding roller is supported by a rotation shaft, which is coaxial with the sheet feeding roller; and a driving shaft, which drives the rotation shaft, wherein axes of the driving shaft and the rotation shaft are parallel, and wherein the axis of the rotation shaft is located outward of the axis of the driving shaft, wherein a roller cover is pivotally supported above the sheet feeding roller, and the roller cover is pivotal between a lower position, in which the roller cover covers an upper part of the sheet feeding roller, and an upper position, in which the sheet feeding roller is substantially exposed.

* * * * *